United States Patent [19]

Fenton

[11] 3,978,835

[45] Sept. 7, 1976

[54] AUTOMATIC CHOKE ASSEMBLY FOR SMALL ENGINES

[75] Inventor: Alvin P. Fenton, Oostburg, Wis.

[73] Assignee: Kohler Company, Kohler, Wis.

[22] Filed: Dec. 4, 1974

[21] Appl. No.: 529,448

[52] U.S. Cl. ..... 123/119 F; 261/39 B

[51] Int. Cl.[2] ..... F02B 33/00

[58] Field of Search ..... 123/119 F, 179 R, 179 B, 123/179 G; 261/39 B, 39 E

[56] References Cited

UNITED STATES PATENTS

| | | | |
|---|---|---|---|
| 1,577,766 | 3/1926 | Sisson | 123/119 F X |
| 2,071,633 | 2/1937 | Hunt | 123/119 F |
| 2,127,653 | 8/1938 | Sisson | 123/119 F X |
| 2,134,421 | 10/1938 | Sisson | 123/119 F |
| 2,377,248 | 5/1945 | Langhaar | 123/119 F |
| 3,401,919 | 9/1968 | Seufert et al. | 123/119 F X |

*Primary Examiner*—Charles J. Myhre
*Assistant Examiner*—Ira S. Lazarus
*Attorney, Agent, or Firm*—Quarles & Brady

[57] ABSTRACT

An automatic choke for an internal combustion engine includes a rotary solenoid which is energized when the engine is cranked by the starter motor. During starting, the solenoid rotates a choke valve to its starting position in which choking is applied, and a bimetallic temperature responsive spring coupling the solenoid to the choke valve adjusts the amount of choking in response to the ambient temperature. A stop element limits the range over which the bimetallic spring adjusts the position of the choke valve.

11 Claims, 7 Drawing Figures

AUTOMATIC CHOKE ASSEMBLY FOR SMALL ENGINES

BACKGROUND OF THE INVENTION

The field of the invention is automatic chokes for internal combustion engines, and more specifically, automatic chokes for small engines having one or two cylinders.

The use of automatic chokes on automotive engines is well known. Typically, a choke valve, or "butterfly", is mounted in the air intake passage of the carburetor and means is provided to automatically orient this valve to provide the desired air-fuel mixture. For example, the choke valve is usually substantially closed while the engine is being started to provide a rich air-fuel mixture. As the engine warms up, the valve is automatically opened to provide a leaner, cleaner burning mixture.

With the recent emphasis on reducing the emissions from automotive engines a number of temperature responsive automatic choke assemblies have been proposed. As disclosed in U.S. Pat. No. 3,752,133, for example, temperature responsive bimetallic coils are used in some of these chokes assemblies to open the choke valve as the engine warms up. Heat directly from the engine may be used to operate the bimetallic coil and in some instances this may be supplemented by a heating element which accelerates opening. Or, as disclosed in U.S. Pat. No. 3,818,881, the bimetallic coil may itself be used as the heating element by passing electric current through it.

A number of unique problems are presented when starting small engines and engines which are controlled by speed governors. When an automatic engine is started, a fast idle cam on the carburetor is engaged to automatically open the throttle a preset amount. A vacuum piston connected to the manifold is operated when the engine starts and this tends to pull the choke valve open against the resistance of the bimetallic coil. As the engine warms up, the resistance of the coil gradually decreases and the choke valve opens. Such a system does not work on small engines, or on engines which are started with the throttle wide open, since a uniform manifold pressure cannot be maintained to provide a force which will gradually open the choke valve against the resistance of the bimetallic coil. Also, on governor controlled engines which are started with the throttle wide open, some choke is required for starting even when the engine is hot.

Summary of the Invention

The present invention relates to an automatic choke assembly for an internal combustion engine in which the choke valve is rotated between a running position and a starting position and in which the orientation of the choke valve in its starting position is responsive to the ambient temperature. More specifically, the choke assembly includes a choke valve which is mounted within the air induction passage of an internal combustion engine and is movable between a running position in which it presents minimal interruption of the flow of air and a starting position in which it substantially blocks, or chokes, the passage of air; a solenoid having a coil which connects to the starter circuit of the internal combustion engine and a solenoid shaft which is responsive to the magnetic field generated by the coil to move between a deenergized and an energized position; a bimetallic spring which couples the solenoid shaft to the choke valve and which is responsive to the ambient temperature to control their relative positions; and means for biasing the choke valve in its running position.

When the engine is started the solenoid is energized and it actuates, or moves, the choke valve to its starting position to substantially block the flow of air to the engine and to thus provide a rich fuel mixture which enhances starting. After the engine starts, the solenoid is deenergized and the bias means moves the choke valve to its running position to provide a leaner fuel mixture. In addition to coupling the motion of the solenoid shaft to the choke valve, the bimetallic spring also adjusts the relative positions of the solenoid shaft and choke valve in response to the ambient temperature. For example, when the engine is cold and the temperature is low, the choke is oriented with respect to the solenoid shaft to provide maximum choking when the solenoid is energized. On the other hand, the choke valve is oriented to provide less choking when the air temperature is higher or the engine has been running. In other words, the bimetallic spring provides an adjustment of the amount of choking that is provided during starting.

A further aspect of the present invention resides in a stop which couples to the choke valve and to the solenoid shaft and which limits the range over which the bimetallic spring can adjust their relative positions. Although there are inherent limits to the range over which the bimetallic spring can adjust the relative positions of the choke valve and solenoid shaft, it has been discovered that for any given engine there exists a range of relative movements for best engine performance. The stop element of the present invention provides preselected limits to the range over which the bimetallic spring can adjust the relative positions of the choke valve and solenoid shaft.

An object of the invention is to provide significant choking of the air induction passage to an internal combustion engine during starting. Regardless of the ambient temperature during starting, choking is provided when the solenoid is energized by the starter circuit.

A further object of the invention is to automatically adjust the amount of choking in response to the ambient temperature. The bimetallic spring is automatically responsive to the air temperature to adjust the orientation of the choke valve with respect to the solenoid shaft. As a result, when the internal combustion engine is started during very cold weather maximum choking is provided and when started in warm weather, significantly less choking is provided during starting. In addition, a heating element is positioned adjacent the bimetallic spring and is electrically connected to the ignition system of the engine. Consequently, if the engine has been running the temperature surrounding the bimetallic spring is increased by the heating element and less choking is provided during starting regardless of weather conditions.

Yet another object of the invention is to provide an automatic choke in which the choke valve is held in its fully choked position during cranking. The solenoid shaft and bimetallic spring provide a positive force which orient the choke valve in its starting position. The automatic choke assembly of the present invention does not, therefore, rely upon a partial vacuum created by the internal combustion engine for proper orientation of the choke valve during starting. As a result, the choke assembly may be used with smaller internal combustion engines having one or two cylinders.

The foregoing and other objects and advantages of the invention will appear from the following description. In the description reference is made to the accompanying drawings which form a part hereof, and in which there is shown by way of illustration a preferred embodiment of the invention. Such embodiment does not necessarily represent the full scope of the invention, however, the reference is therefore made to the claims for interpreting the scope of the present invention.

DESCRIPTION OF THE PREFERRED EMBODIMENT

Figure 1:
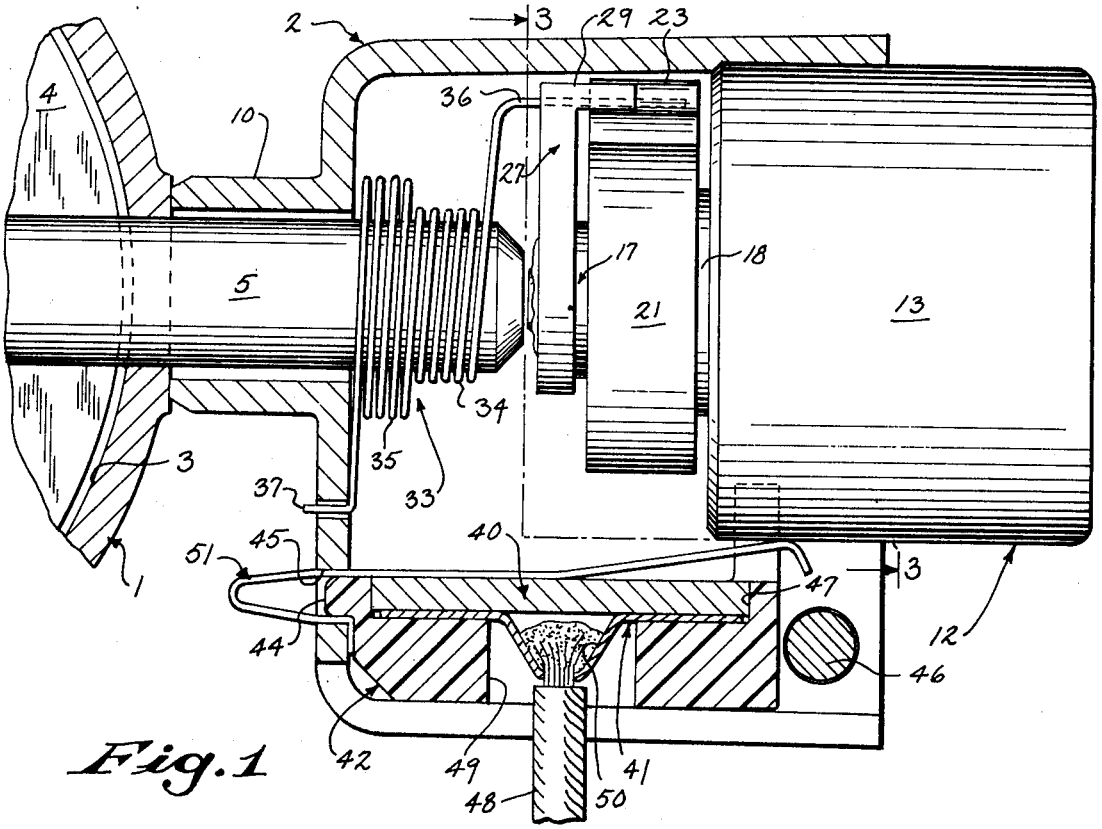
FIG. 1 is a side view with parts cut away of the choke assembly of the present invention.
Figure 3:
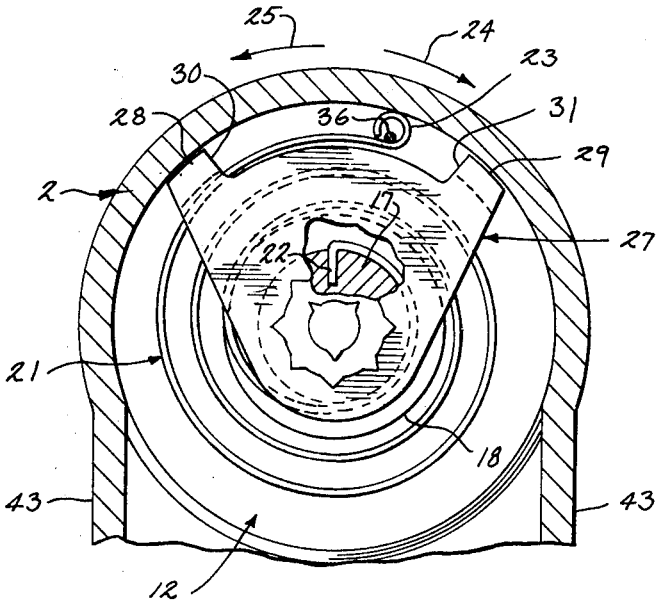
FIG. 3 is a view in cross section taken through the plane indicated by the line 3—3 in FIG. 1, and FIGS. *4a–4d* are schematic diagrams of the invented choke assembly.
Figure 2:
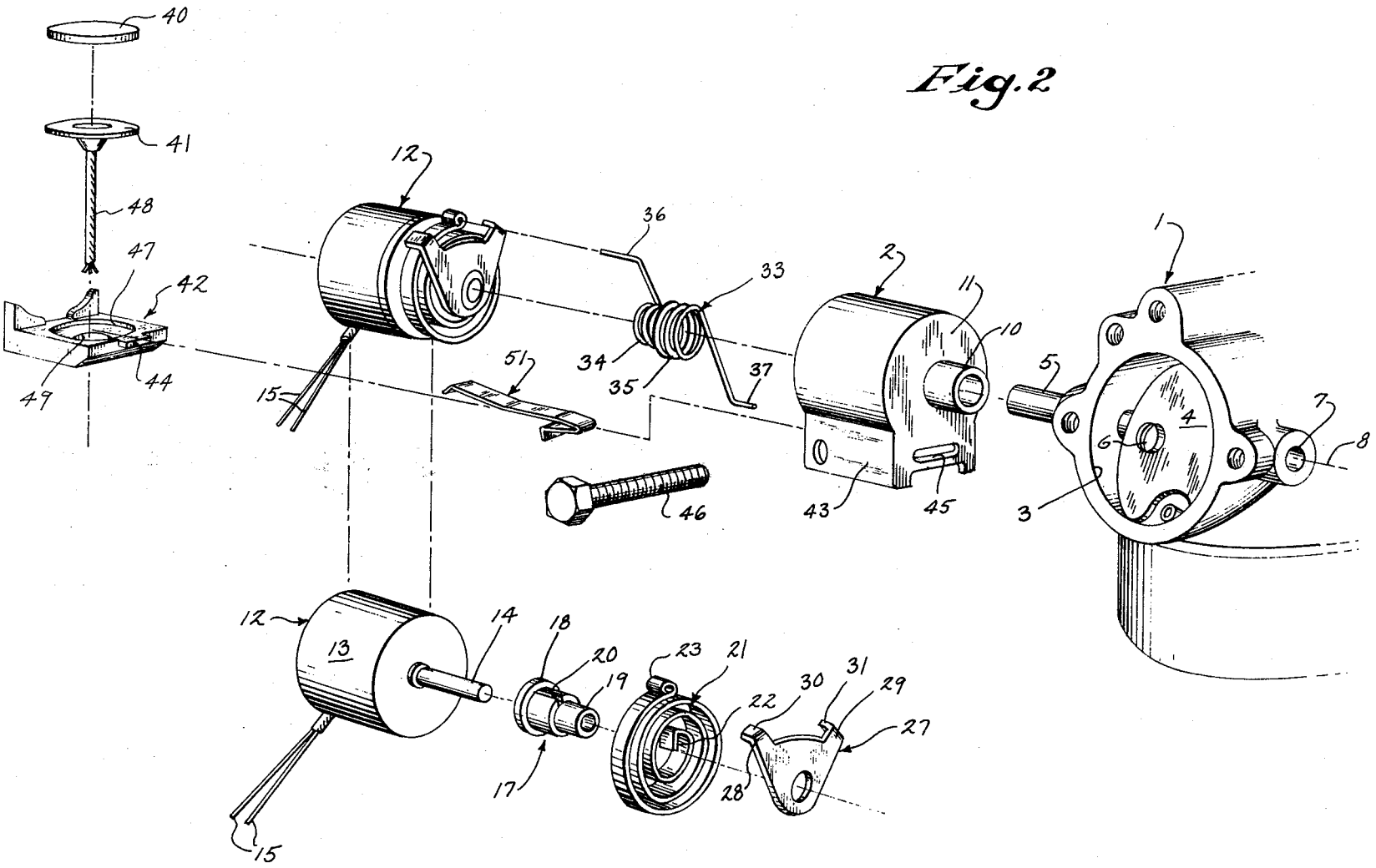
FIG. 2 is an exploded perspective view of the choke assembly shown in FIG. 1.

Referring particularly to FIGS. 1—3, the choke assembly of the present invention is mounted to a carburetor 1 and is contained within a cylindrically shaped housing 2. The carburetor 1 is of conventional construction and includes an air induction passage 3 which extends horizontally through the carburetor 1 to the intake port of an internal combustion engine (not shown in the drawings). A choke valve 4 is contained within the passage 3 and is fastened to a choke shaft 5 by a screw 6. The choke shaft 5 extends transversely through the air induction passage 3 and is journaled in a pair of openings 7 formed on opposite walls of the carburetor 1 to rotate about a horizontal operating axis 8. By rotating the choke shaft 5, the choke valve 4 may be positioned in a fully choked position in which it substantially blocks the air induction passage 3 or an unchoked position in which the choke valve 4 is positioned substantially horizontal within the air induction passage 3 to provide minimal interruption of air flow into the carburetor 1.

The choke assembly housing 2 is mounted along the operating axis 8 and the choke shaft 5 extends into the housing 2 through a cylindrical sleeve 10 which is integrally formed to a housing end wall 11. The opposite end of the housing 2 is open and a rotary solenoid 12 such as that disclosed in U.S. Pat. No. 3,144,593 which issued to R. J. Ganowsky on Aug. 11, 1964 is rigidly mounted therein. It includes a cylindrical body portion 13 which contains an electric coil (not shown in the drawings), and a solenoid shaft 14 which is rotatably mounted to the body 13 and extends from one of its ends along the operating axis 8. The solenoid shaft 14 is thus coaxial with the choke shaft 5. When energized by applying a d-c voltage to a pair of leads 15, the solenoid coil generates a magnetic field which causes the solenoid shaft 15 to rotate approximately 30° from a deenergized position to an energized position. The coil leads 15 are connected into the starter circuit of the internal combustion engine so that the solenoid 13 is energized whenever the engine is cranked by the starter motor.

The solenoid shaft 14 is coupled to rotate the choke valve 4 from its unchoked position to its choked position when the solenoid 12 is energized. A nylon hub 17 is securely fastened to and disposed around the solenoid shaft 14 and it includes an integrally formed flange 18 which is disposed immediately forward of the solenoid body 13. A constricted neck portion 19 on the hub 17 surrounds the forward end of the solenoid shaft 14, and an integrally formed keyway 20 is formed in the mid portion of the hub 17 in the direction of the operating axis 8.

A coiled, bimetallic thermostatic spring 21 connects to the hub 17 to provide temperature dependent coupling between the solenoid shaft 14 and the choke shaft 5. An inner end 22 on the spring extends radially inward towards the operating axis 8 and is received in the keyway 20 on the hub 17. Referring particularly to FIG. 3, the bimetallic spring 21 is wound in a clockwise direction from the inner end 22 when locking in the direction of the solenoid 12, and its outer end is curled to form an eye 23. At 70° F., the eye 23 is 16° to the right of a vertical plane through the actuator axis 8. The bimetallic spring 21 is a commercially available thermostatic element which is responsive to the ambient temperature within the housing 2 to move the eye 23 circumferentially with respect to the solenoid shaft 14. When the ambient temperature increases, the bimetallic spring 21 coils tighter to translate the eye 23 clockwise as indicated by the arrow 24, whereas the eye 23 is translated counterclockwise in the direction of the arrow 25 when the ambient temperature in the housing 2 decreases.

Mounted to the hub 17 and disposed around its neck portion 19 is a nylon stop member 27. The stop member 27 extends radially outward and upward from the hub 17 and includes a pair of integrally molded ears 28 and 29. The ears 28 and 29 are symmetrical about a vertical plane through the actuator axis 8 and are folded back toward the solenoid 12 to form a lower stop 30 and an upper stop 31. The lower and upper stops 30 and 31 are spaced circumferentially from one another by approximately 76°. As will become more apparent from the description which follows, the lower and upper stops 30 and 31 provide limits to the range over which the bimetallic spring 21 can adjust teh relative orientation of the choke valve 4 with respect to the solenoid shaft 14.

Referring particularly to FIGS. 1–3, a coiled spring 33 connects the eye 23 on the bimetallic spring 21 with the choke shaft 5. The spring 33 is compriised of two sections, a clutch portion 34 and a bias portion 35. The clutch portion 34 is wound tightly about the choke shaft 5 and includes a coupling end 36 which extends rearward between the stops 30 and 31 into the eye 23 on bimetallic spring 21. The bias portion 35 is loosely wound about the choke shaft 5 and is terminated at an end 37 which is anchored to the housing 2. The coiled spring 33 serves two purposes. First, the clutch portion 34 serves to couple the bimetallic spring 21 to the choke shaft 5. Secondly, the bias portion 35 serves to bias the choke valve 4 in its unchoked, or running position. The torque generated by the solenoid 12 when it is energized opposes the torque generated by the bias portion 35 of the spring 33 and the torque acting on the clutch portion 34 of the spring 33 tighten it about the choke shaft 5 to insure tight coupling between the solenoid 12 and choke valve 4. Thus, when energized, the solenoid 12 rotates the hub 17, the bimetallic spring 21, the coiled spring 33, choke shaft 5 the choke valve 4 to their starting position in which choking is applied to provide a rich air-fuel mixture, and after the engine starts and the solenoid 12 is deenergized the bias portion 35 of the spring 33 returns the assembly to its running position in which minimal choking is applied.

Mounted within the housing 2 and electrically connected to the ignition circuit of the internal combustion engine is a temperature sensitive heater element 40. The heater element 40 is a disc-shaped ceramic resistance element which is commercially available from the Texas Instruments Company and which provides an abrupt and substantial increase in resistivity above a selected temperature. The heater element 40 is supported by a molded nylon base member 42. The base member 42 is disposed between a pair of downward extending side walls 43 on the housing 2 and it includes an integrally molded ear 44 which extends forward into a slot 45 formed in the end wall 11 of the housing 2. The base member 42 encloses the bottom of the housing 2 and is held in place by a bolt 46 which clamps it between the side walls 43.

The terminal plate 41 and heater element 40 rest in a circular recess 47 which is formed in the top surface of the base member 42. A lead wire 48 extends upward through an opening 49 in the base element 42 and is soldered to a conical recess 50 formed at the center of the terminal plate 41. A metal contact arm 51 wraps around the ear 44 on the base member 42 and extends rearward across the top surface of the heater element 40 and into contact with the body portion 13 of the rotary solenoid 12. The ear 44 wedges the contact arm 51 against the top and bottom walls of the slot 45 to provide electrical connection between the housing 2 and the top surface of the heater element 40. The housing 2 is at circuit ground and the lead wire 38 is connected to the ignition circuit of the internal combustion engine. When the engine is running, therefore, electric current flows through the lead wire 48, terminal plate 41 and heater element 40 to the contact arm 51. The heat generated by the heating element 40 raises the ambient temperature in the housing 2 until it reaches a temperature of approximately 150° F. At this temperature the resistance of the heating element 40 increases substantially to reduce the amount of current and the amount of generated heat. An equilibrium temperature of approximately 150° is thus reached and maintained within the housing 2 as the engine continues to operate.

Figure 4A:
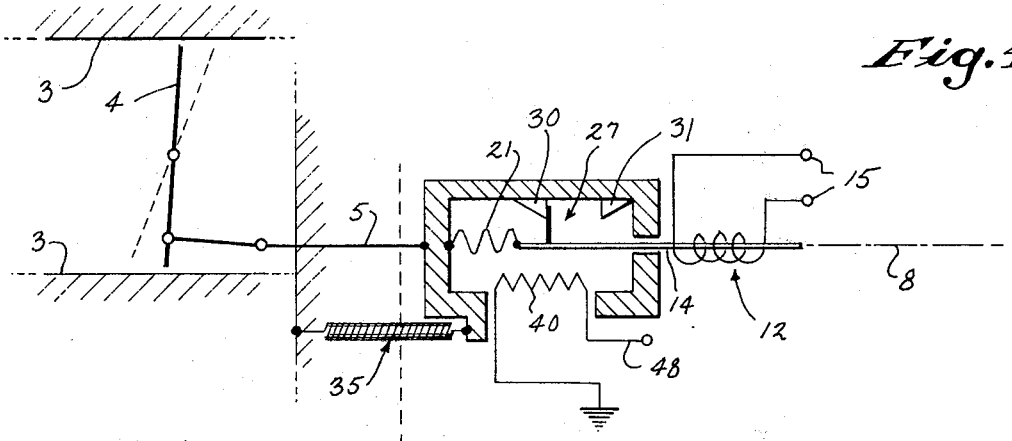

The operation of the choke assembly will be explained first with the use of the schematic diagrams in FIGS. 4*a–d* in which the elements operate linearly along the operating axis 8 rather than rotate thereabout as described above. Elements which are equivalent to those described above have been indicated with like reference numbers. Referring particularly to FIG. 4*a*, the choke is shown in its starting position when the ambient temperature is very cold. The biametallic spring 21 is contacted and it draws the assembly and attached choke shaft 5 to the right until the lower stop 30 of the stop element 27 is engaged. The energized solenoid 12 holds the assembly in the position shown against the force generated by the bias spring 35 and the choke valve 4 is thereby held in a starting position in which it provides maximum inpedance to the flow of air through the air induction passage 3.

Figure 4B:
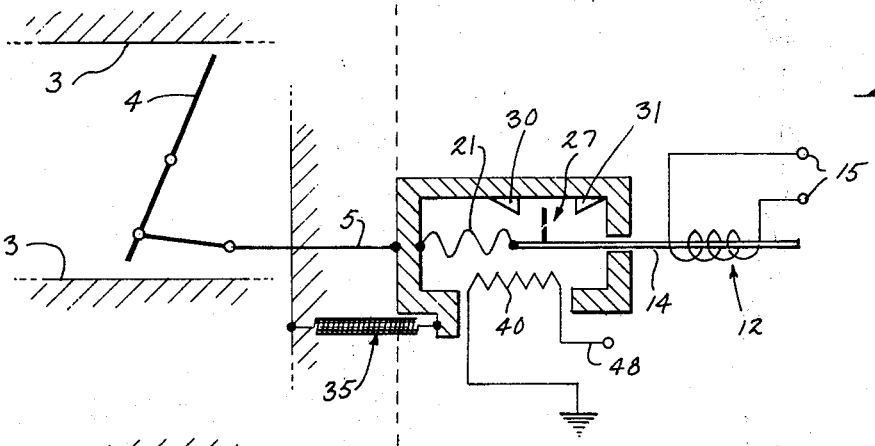
Figure 4C:
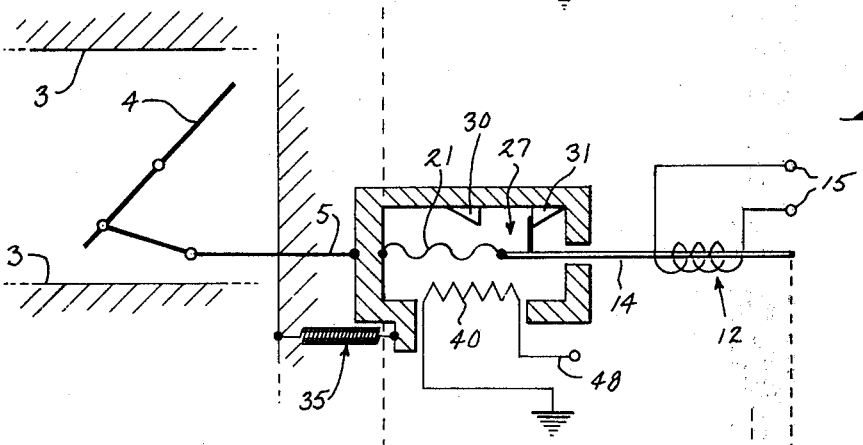
Figure 4D:
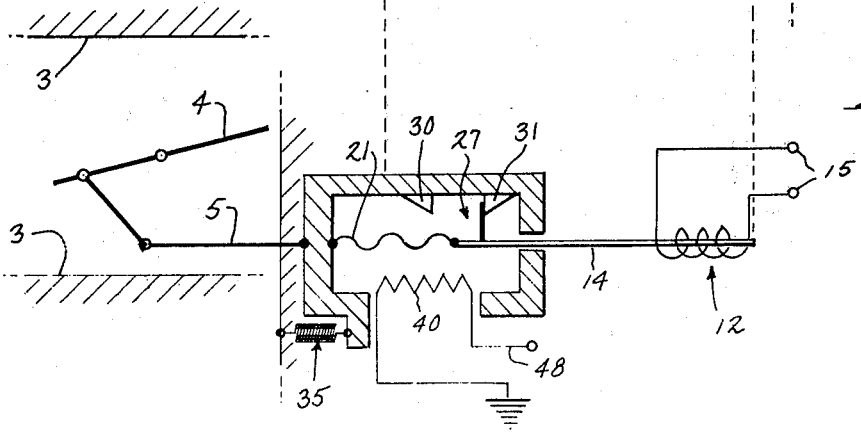

Referring to FIG. 4*b*, the choke is shown in its starting position when the ambient temperature is relatively high. The bimetallic spring 21 is lengthened due to the higher ambient temperature and the assembly with attached choke shaft 5 is translated to the left of the cold starting position shown in FIG. 4*a*. As a result, the choke valve 4 provides slightly less blockage of air during starting to allow a somewhat leaner fuel mixture to reach the internal combustion engine. Referring to FIG. 4*c*, the choke is shown in its starting position after the engine has been running for a period of time. The heating element 40 has increased the ambient temperature and the bimetallic spring 21 has lengthened to draw the assembly to the left against the upper stop 31. Less choking is thus provided. As shown in FIG. 4*d*, after the engine has been started the solenoid 12 is deenergized and the entire assembly with attached choke shaft 5 is translated to the left by the bias spring 35. The choke valve 4 is thus rotated to its running position in which minimal impedance to the flow of air through the passage 3 is provided.

Referring again to FIGS. 1–3, the preferred embodiment of the choke assembly operates substantially the same as the linear version of the invention shown schematically in FIGS. 4*a–d*. However, instead of adjusting the relative positions of the solenoid shaft 14 and choke shaft 5 along the operating axis 8, the bimetallic spring 21 adjusts their relative angular positions about the actuator axis 8. As a result, when the solenoid 12 is energized during starting, the choke valve 4 is rotated to its starting position in which its orientation within the air induction passage 3 is determined in part by the temperature responsive bimetallic spring 21. The range over which the bimetallic spring 21 adjusts the position of the choke valve 4 is limited by the angular spacing of the lower and upper stops 30 and 31. In the preferred embodiment described, this range is approximately 76°. When very cold, the eye 23 on the bimetallic spring 21 is drawn counterclockwise until the coupling end 36 on the spring 33 engages the lower stop 30. During starting, therefore, the choke valve 5 is oriented in a nearly vertical plane within the air induction passage 3 to provide maximum blockage, corresponding to that illustrated schematically in FIG. 4*a*. At the other extreme after the engine has been running and the heater element 40 has raised the ambient temperature within the housing 2, the coupling end 36 on the spring 33 is driven against the upper stop 31 by the bimetallic spring 21. As a result, when the engine is cranked by the starting motor and the solenoid 12 is energized, less full choke is applied to provide a leaner fuel mixture to the engine during starting corresponding to that illustrated schematically in FIG. 4*c*, After the engine is started, the solenoid 12 is deenergized and the bias portion 35 of the spring 33 rotates the choke valve 4 to its running position corresponding to that shown schematically in FIG. 4*d*.

It should be apparent to those skilled in the art that numerous variations can be made in the preferred embodiment described herein without departing from the spirit of the invention. The spacing of the stops 30 and 31, the extent to which the solenoid 12 rotates the choke valve 4, the temperature at which the heating element 40 reaches equilibrium, and the responsiveness of the bimetallic spring 21 to temperature variations are all variable and depend on the specific requirements of the engine to which the choke assembly is attached. The preferred embodiment of the choke assembly described herein is designed for use on the Model KL-341 engine manufactured and sold by the Kohler Company and which is a 16-horsepower, four-cycle, single cylinder, air-cooled engine having a displacement of 35.9 cubic inches. Also, variations can be made in the mechanical apparatus such as mounting the stop element to the choke rather than the solenoid shaft, using means other than a rotary solenoid to rotate the choke valve between its running and starting positions, and using any number of means for biasing the choke valve in its running position. In addition, it is not necessary that the operating axis of the choke assembly coincide means are available for coupling the motion of the choke assembly to the choke valve which do not require their coaxial alignment.

I claim:

1. An automatic choke assembly for controlling the flow of air through the air induction passage of an internal combustion engine, the combination comprising:

a choke valve positioned within said air induction passage and mounted for rotation between a running position in which it provides minimal interruption of the flow of air through said passage and a starting position in which it provides substantial interruption of the flow of air through said passage;

bias means coupled to said choke valve to orient it in its running position;

a choke shaft coupled to said choke valve and being operable when moved to rotate said choke valve;

actuation means for moving an actuator shaft from a running position to a starting position when the engine is being started; and temperature responsive coupling means having one end connected to said choke shaft and its other end connected to said actuator shaft to couple the motion of said actuator shaft to said choke shaft and to adjust their relative positions as a function of the ambient temperature.

2. The automatic choke assembly as recited in claim 1 in which a stop element connects to said actuator shaft and said choke shaft to limit the range over which said temperature responsive coupling means can adjust their relative positions.

3. The automatic choke assembly as recited in claim 2 which includes heater means for increasing the ambient temperature when said engine is running.

4. An automatic choke assembly for controlling the orientation of a choke valve within the air induction passage of an internal combustion engine, the combination comprising:

a rotatably mounted choke shaft connected to said choke valve;

a bias spring connected to rotate said choke shaft and position said choke valve in a first position;

a solenoid having a coil which connects to the starting circuit of said internal combustion engine and a solenoid shaft which moves from a deenergized to an energized position when said coil is energized; and a bimetallic spring connected between said choke shaft and said solenoid shaft to couple the motion of said solenoid shaft to the choke shaft and to adjust their relative positions as a function of the ambient temperature.

5. The automatic choke assembly as recited in claim 4 which includes a stop element coupled to said choke shaft and said solenoid shaft to limit the range over which the bimetallic spring controls their relative positions.

6. The automatic choke assembly as recited in claim 5 in which a heater element is mounted adjacent said bimetallic spring and is connected to the ignition circuit of said internal combustion engine to generate heat when said engine is running.

7. The automatic choke as recited in claim 5 in which said solenoid shaft rotates when said coil is energized and said solenoid shaft is coaxial with said choke shaft.

8. An automatic choke assembly for an internal combustion engine, the combination comprising:

a choke shaft rotatably mounted to the walls of an air induction passage on said internal combustion engine;

a choke valve mounted to said choke shaft within said air induction passage;

a rotary solenoid having a coil which connects to the starting circuit on said engine and a solenoid shaft which is coaxial with said choke shaft and which rotates a preselected amount from a deenergized to an energized position when said coil energized;

a bimetallic spring having one end connected to the solenoid shaft and another end connected to the choke shaft, the relative circumferential alignment of said ends about the common axis of said choke shaft and solenoid shaft being responsive to the ambient temperature to adjust the relative angular orientation of said choke shaft and said solenoid shaft.

9. The automatic choke assembly as recited in claim 8 in which a stop element is mounted to one of said shafts and includes an upper stop and a lower stop which are spaced a preselected angular distance from one another and which interact with said other shaft to limit the range over which the bimetallic spring can adjust the relative angular orientaion of said shafts.

10. The automatic choke assembly as recited to claim 8 in which a heater element is mounted beneath said bimetallic spring and is connected to the ignition system of the engine to raise the ambient temperature to a preselected value when said engine is running.

11. An automatic choke assembly for controlling the orientation of a choke valve within the air induction passage of an internal combustion engine, the combination comprising:

a choke shaft mounted for rotation about an axis and connected to said choke valve;

a rotary solenoid having a coil which connects to the starting circuit of said internal combustion engine and a solenoid shaft which is coaxially aligned with said choke shaft and coupled thereto, said solenoid shaft being rotated about said axis from a deenergized to an energized position when said coil is energized to impart a corresponding rotation to said choke shaft; and a bimetallic spring coupled to said choke shaft to adjust the orientation of said choke shaft about said axis as a function of the ambient temperature.

* * * * *

UNITED STATES PATENT AND TRADEMARK OFFICE

CERTIFICATE OF CORRECTION

PATENT NO. : 3,978,835

DATED : September 7, 1976

INVENTOR(S) : Alvin P. Fenton

It is certified that error appears in the above-identified patent and that said Letters Patent are hereby corrected as shown below:

| | |
|---|---|
| Column 1, line 24 | "chokes" should be -- choke -- |
| Column 1, line 34 | "automatic" should be -- automotive -- |
| Column 2, line 17 | "choke is" should be -- choke valve is -- |
| Column 3, line 10 | "the reference" should be -- and reference -- |
| Column 4, line 13 | "spring" should be -- spring 21 -- |
| Column 4, line 17 | "locking" should be -- looking -- |
| Column 4, line 43 | "teh" should be -- the -- |
| Column 4, line 48 | "compriised" should be -- comprised -- |
| Column 4, line 62 | "torque" should be -- torques -- |
| Column 4, line 67 | "5 the" should be -- 5 and -- |
| Column 5, line 14 | "by a molded" should be -- by a circular metallic terminal plate 41 which in turn is supported by a molded -- |
| Column 5, line 35 | "lead wire 38" should be -- lead wire 48 -- |
| Column 5, line 56 | "biametallic" should be -- bimetallic -- |
| Column 5, line 57 | "contacted" should be -- contracted -- |
| Column 5, line 63 | "inpedance" should be -- impedance -- |

continued. . .

UNITED STATES PATENT AND TRADEMARK OFFICE

CERTIFICATE OF CORRECTION

PATENT NO. : 3,978,835

DATED : September 7, 1976

INVENTOR(S) : Alvin P. Fenton

It is certified that error appears in the above-identified patent and that said Letters Patent are hereby corrected as shown below:

| | |
|---|---|
| Column 6, line 49 | "Fig. 4c," should be -- Fig. 4c. -- |
| Column 6, line 67 | "16-horsepower" does not need to be bold face |
| Column 7, line 3 | "choke rather" should be -- choke shaft rather -- |
| Column 7, line 9 | "coincide means" should be -- coincide with that of the choke valve. A number of transmission means -- |
| Column 8, line 25 (Claim 8) | "coil energized" should be -- coil is energized -- |
| Column 8, line 41 (Claim 10) | "to claim" should be -- in claim -- |

Signed and Sealed this

Twenty-third Day of November 1976

[SEAL]

*Attest:*

RUTH C. MASON
*Attesting Officer*

C. MARSHALL DANN
*Commissioner of Patents and Trademarks*